US008091194B2

(12) United States Patent
Clatot

(10) Patent No.: US 8,091,194 B2
(45) Date of Patent: Jan. 10, 2012

(54) SYSTEM FOR SEPARATING TWO EQUIPMENT ITEMS EACH HAVING A CHAMBER TIGHTLY LINKED TO THAT OF THE OTHER ONE

(75) Inventor: Raphaël Clatot, Talence (FR)

(73) Assignee: Commissariat a l'Energie Atomique (FR)

( * ) Notice: Subject to any disclaimer, the term of this patent is extended or adjusted under 35 U.S.C. 154(b) by 1084 days.

(21) Appl. No.: 11/915,248

(22) PCT Filed: May 29, 2006

(86) PCT No.: PCT/FR2006/050488

§ 371 (c)(1),
(2), (4) Date: Nov. 21, 2007

(87) PCT Pub. No.: WO2007/003825

PCT Pub. Date: Jan. 11, 2007

(65) Prior Publication Data

US 2008/0199291 A1 Aug. 21, 2008

(30) Foreign Application Priority Data

May 31, 2005 (FR) ..... 05 51438

(51) Int. Cl.
*B24P 19/04* (2006.01)

(52) U.S. Cl. ..... 29/239; 29/238; 29/243.55; 29/243.57; 29/281.6; 251/326; 285/412

(58) Field of Classification Search ..... 29/239, 29/238, 243.55, 243.57, 281.6; 251/326–329; 285/412, 368

See application file for complete search history.

(56) References Cited

U.S. PATENT DOCUMENTS 4,009,727 A * 3/1977 Bailey ..... 137/454.2
4,235,257 A * 11/1980 Wolf ..... 137/242
4,666,270 A * 5/1987 Hager ..... 251/326
4,732,527 A 3/1988 Conche
4,866,286 A 9/1989 Baatz et al.

(Continued)

FOREIGN PATENT DOCUMENTS

EP 0212028 8/1985

(Continued)

OTHER PUBLICATIONS

English translation of International preliminary Examination Report.

*Primary Examiner* — George Nguyen
(74) *Attorney, Agent, or Firm* — Baker & Hostetler LLP

(57) ABSTRACT

The system according to the invention allows the separation of two equipment items of an installation in a confined environment, without interrupting the confinement inside this installation.

Figure 1:
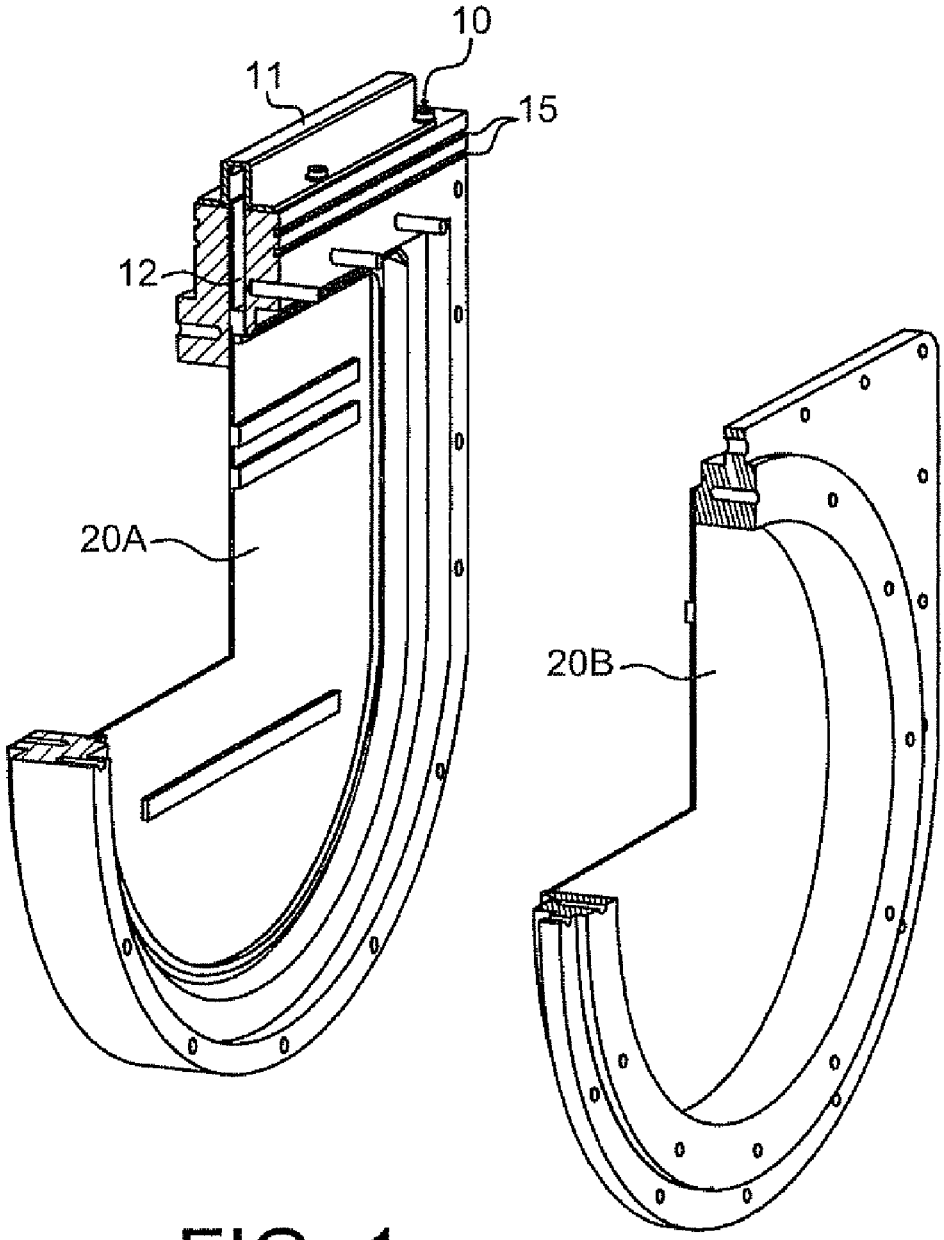

It primarily comprises a confinement flange (10) placed tightly between the two parts of the installation, and comprising a slot (12) protected by a temporary cover (11). The assembly is completed by a guillotine made up of two closure plates (20A, 20B) pressed against each other before their insertion into the slot (12). Once this insertion of the guillotine is complete, the two closure plates (20A) and (20B) can be separated from each other so as to each constitute a tight covering of the two parts of the installation to be separated.

Application to confinement installations for the implementation of vacuum intervention methods where one wishes to maintain a special confinement.

9 Claims, 5 Drawing Sheets

U.S. PATENT DOCUMENTS

| | | | | |
|---|---|---|---|---|
| 4,897,963 | A * | 2/1990 | Reboul et al. | 49/507 |
| 5,020,776 | A * | 6/1991 | Owens et al. | 251/327 |
| 6,375,157 | B1 * | 4/2002 | Van de Lande | 251/327 |
| 6,672,139 | B2 * | 1/2004 | Pampinella | 73/49.8 |
| 6,997,041 | B1 * | 2/2006 | Metzger et al. | 73/37 |
| 7,325,442 | B1 * | 2/2008 | Pampinella et al. | 73/49.8 |
| 7,731,242 | B2 * | 6/2010 | Coscarella | 285/236 |
| 2003/0194042 | A1 | 10/2003 | Singh et al. | |

FOREIGN PATENT DOCUMENTS

| | | |
|---|---|---|
| EP | 0312460 | 10/1988 |
| FR | 2613526 | 4/1986 |

* cited by examiner

SYSTEM FOR SEPARATING TWO EQUIPMENT ITEMS EACH HAVING A CHAMBER TIGHTLY LINKED TO THAT OF THE OTHER ONE

FIELD OF THE INVENTION

The invention relates to the management and handling and material and objects in a confined environment, particularly in the field of nuclear installations. It relates in particular to the problem relative to equipment maintenance in confined and controlled installations, in particular to the separation of two chambers tightly connected and having to be separated, the inside of each chamber having to remain confined.

PRIOR ART AND PROBLEM POSED

In processing installations and installations for contaminated materials, in the nuclear field, it is common to use two equipment items each made up of a chamber, among other things, and which are operatively connected in a vacuum-tight manner. In the framework of maintenance for these equipment items, they commonly must be separated from each other. To this end, it is desirable to control the dispersion of pollution resulting from the chambers, toward the rest of the installation. Several reference solutions are known and described in works on standards for nuclear centers, in particular under the title "enceintes de confinement et éléments de transfert—chapitre IV.2" ("confinement chambers and transfer elements—chapter IV.2") as well as the NF ISO 1 933-3 standard, "composant et enceinte de confinement" ("confinement component and chamber").

A first technique consists of using a bag made of a flexible and tight material, such as a vinyl bag, tightly around the junction plane of the two equipment items to be separated. It is then possible to mechanically separate the two elements from each other, create two tight chambers at each end of the flexible bag, and cut the bag in two between the chambers thus formed to free the two equipment items, one part of the bag keeping each chamber closed. This method is inexpensive, but difficult to execute on large flanges. Moreover, the use of bolted flanges prohibits the use of the double groove needed to fix the flexible bag. In the case of heavy equipment, resting on legs, implementation of this solution is complicated. Also, in the case of material having large diameters, operative implementation with nuclear ventilation is difficult due to the vacuum. However, it presents the advantage of allowing realization without interrupting the confinement, with static sealing.

Another solution consists of using a tight double door transfer system. In this case, the two equipment items to be connected each have an identical tight door. These two equipment items are then placed against each other at the level of the tight doors, which are made integral with each other. This two-door unit is then removed from the two opening frames, thereby freeing the passage. This method is relatively simple and pollution-resistant, but quite costly. Moreover, it is not designed for use under vacuum. It is linked to the use of a glove box or a telemanipulator, which makes it possible to simultaneously open the two doors through the inside of the equipment.

The purpose of the invention is therefore to propose a system allowing two items of equipment comprising chambers, placed tightly connected relative to the vacuum, to be easily separated, safely and tightly, while avoiding the described drawbacks relative to the two methods described above.

SUMMARY OF THE INVENTION

To the end, the main purpose of the invention is a system for separating two equipment items each having a chamber having to be operatively linked to the chamber of the other equipment item, this operative link requiring vacuum-tightness and it being desirable to control the dispersion of pollution toward the exterior of the equipment items, during maintenance operations.

According to the invention, the system comprises:

- a confinement flange placed between and fixed to the two chambers, made up of a female flange and a male flange, placed and fixed temporarily against each other, the confinement flange having a slot and means for blocking said slot;
- two closure plates able to be placed in the slot and to tightly block the chambers placed opposite the flange.

In this way, the two equipment items may be separated from each other, the two chambers each being independently hermetically sealed by a closure plate.

In a preferred embodiment of the invention, the means for blocking the slot are made up of a longitudinal cover.

This is advantageously completed by a cover seal.

In the preferred embodiment of the invention, a sealing joint is used between the male flange and the female flange, in a different plane parallel to that defined by the slot and the closure plane of the closure plates. This means not having a joint straddling, which is to say in the same plane as, the mechanical link between the two closure plates and allows the possibility of vacuum-tightness.

To facilitate the maintenance and invention of closure plates against each other, each of these plates has at least two strips each bearing on a strip of the other plate.

Moreover, there is preferably a handle on one of the closure plates, preferably on the larger of the two plates.

To perfect the tightness of the assembly formed by the two plates, the use of a plate joint is also provided for, this plate joint being placed between the two plates, over the entire periphery thereof.

To improve the pollution-resistance, it is also useful to use a pollution joint around the opening of the slot to insulate this slot.

Lastly, a double groove is provided for on the exterior part of the confinement flange for fixing of a sealing bag allowing the disassembly and introduction of closure plates, without interrupting the confinement.

LIST OF FIGURES

Figure 2:
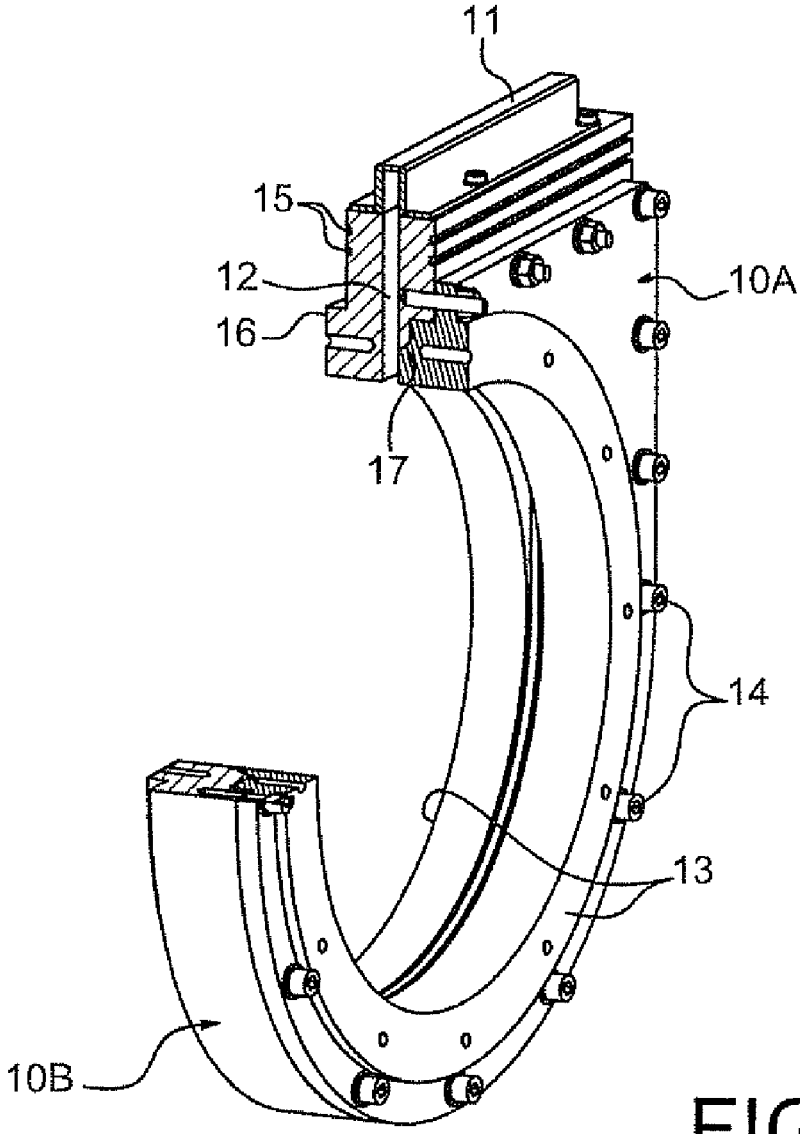
Figure 3A:
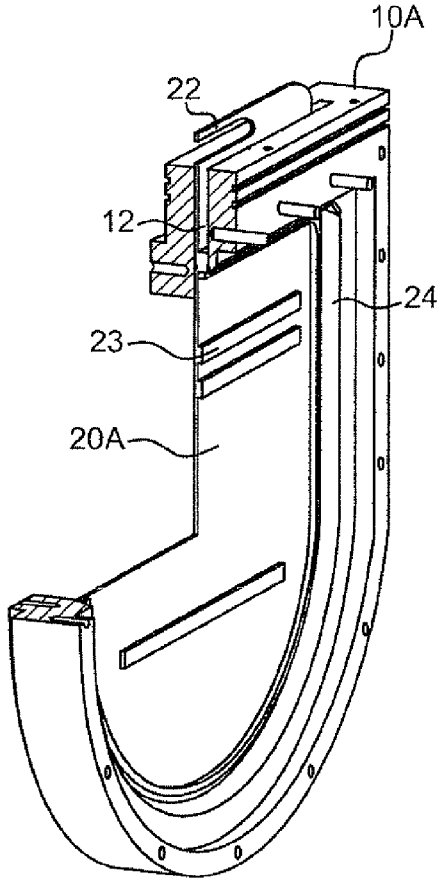
Figure 3B:
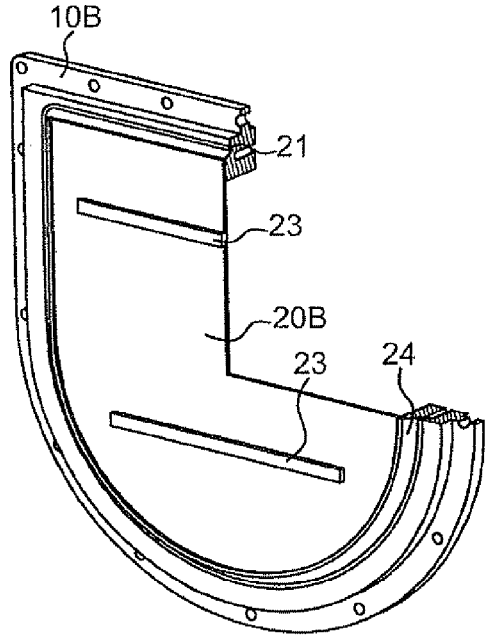
Figure 4:
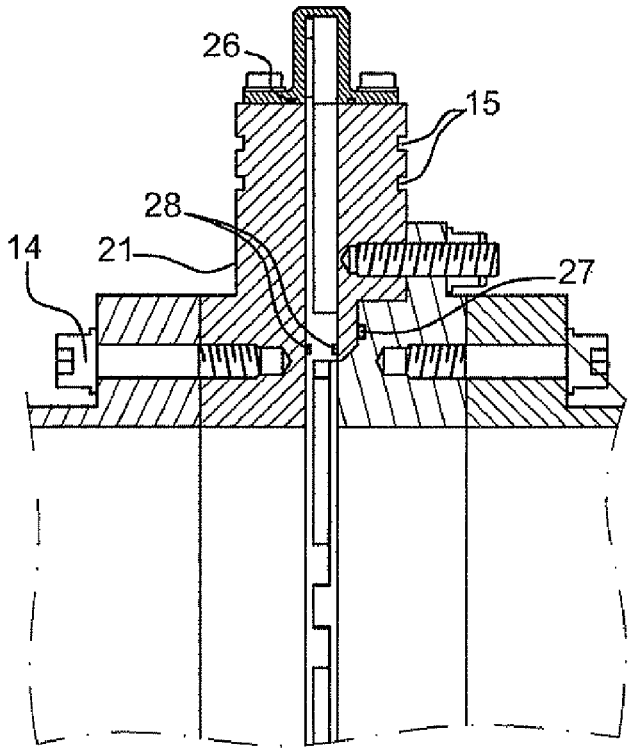
Figure 5:
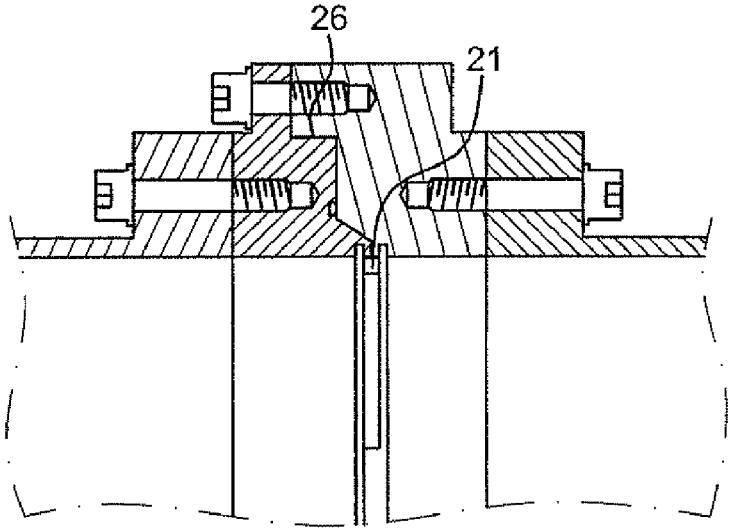

The invention and its various technical characteristics will be better understood upon reading the following description, accompanied by several figures, respectively illustrating:

FIG. 1, in exploded isometric view, the separation system assembly according to the invention;

FIG. 2, in isometric view, the confinement flange of the system according to the invention;

FIGS. 3A and 3B, in isometric view, the two closure plates used in the system according to the invention;

FIG. 4, in partial vertical cross-section, relative to FIGS. 1 and 2, the system according to the invention;

FIG. 5, in partial horizontal cross-section relative to FIGS. 1 and 2, the system according to the invention;

FIGS. 6A to 6D, four phases of the use of the system according to the invention.

DETAILED DESCRIPTION OF ONE EMBODIMENT OF THE INVENTION

FIG. 1 shows, in an exploded view, meaning that the parts are separated from each other, the system according to the invention. This invention is made up primarily of a confinement flange 10 and two closure plates 20A and 20B, respectively the female closure plate 20A and male closure plate 20B. The female closure plate 20A is shown in the closed position, meaning that it is inserted in the confinement flange 10, thanks to a slot 12 located in the upper part of the confinement flange 10. This flange 10 is shown and completed by a cover 11 intended to close the slot 12, when the closure plates 20A and 20B are not to be inserted into or removed from the confinement flange 10. In this same figure, a double groove 15 is shown formed in the upper part of the confinement flange 10. One will note that the illustration of this FIG. 1 is not in accordance with the operation of the system according to the invention, since this FIG. 1 is an exploded view.

FIG. 2 shows the confinement flange assembly 10 from FIG. 1, which is therefore made up of the female flange 10A in which the male flange 10B is fixed. Indeed, the male flange 10B is pressed so as to fit into the female flange 10A. The terms male, and "female" are due to the fact that the female flange 10A is larger than the male flange 10B and that the latter is pressed against the female flange 10A, going slightly inside it among others through a conical surface 17. The permanence of the fixing is ensured by fixing screws 14 placed at the edge of the assembly and going through the two female flanges 10A and the male flange 10B. One can see, on the side of the female flange 10A, opposite the side receiving the male flange 10B, the presence of a protruding part constituting a junction flange 16. This part of the female flange 10A constitutes a standard normalized vacuum interface of the ISO-F type. In the embodiment provided for, the size of this assembly may be in the vicinity of 60 to 70 mm.

This confinement flange 10 assembly remains fixed in place on the installation during disassembly of the equipment item. It is in fact part of the installation.

Two important elements of the system according to the invention are made up of the female 20A and male 20B closure plates, also called female and male "guillotines". These elements are illustrated in FIGS. 3A and 3B respectively, assembled on their respective female 10A and male 10B flange. As shown in FIG. 3A, the female closure plate 20A is illustrated inserted into the slot 12 of the female flange 10A and exceeds the latter by a handle 22 which is used to manipulate all of the female 20A and male 20B closure plates.

In FIG. 3B, the male closure plate 20B is illustrated assembled in its male flange 10B. A sealing joint 21 is placed on the male flange 10B, such that, when this assembly is applied against the female assembly illustrated in FIG. 3A, the space between the female 20A and male 20B closure plates are tightly insulated. One shall note on this subject that this space is very narrow and defines a zone to be decontaminated 24, when the system is separated. This sealing joint 21 makes it possible to put this space under vacuum. One shall note that, like the female flange 10A, the male flange 10B has a standard interface relative to the vacuum of the ISO F type.

On the surface of each of the closure plates 20A and 20B located opposite the other closure plate, there are several strips 23, namely at least two, horizontal, each placed so as to rest against a strip of the opposite plate for the purpose of facilitating the insertion and removal of the assembly formed by the two closure plates, by transmitting the effort for causing the assembly to move relative to the confinement flange. Moreover, they are used to stiffen each of the closure plates. These strips 23 may be magnetized to facilitate the simultaneous insertion of the two closure plates in the slot 12 of the confinement flange 10.

In FIG. 4, which shows a vertical partial cross-section of the entire system according to the invention, we have shown joints which contribute to the tightness of the assembly. A first sealing joint 26 is placed between the male flange 10B and the female flange 10A, at the end of the conical surfaces 17 through which these female 10A and male 10B flanges bear on each other. One shall note that the vertical plan in which this sealing joint is located is different from the insertion plane of the two closure plates 20A and 20B. This makes it possible to obtain vacuum-tightness.

A cover joint 27 is also placed between the bearing surface of the cover 11 and the upper surface of the female flange 10A, on both sides of the slot 12.

A pollution joint 28 is placed on either side of the upper part of the female closure plate 20A to insulate the opening of the slot 12.

Lastly, the plate joint 21 has also been illustrated.

In FIG. 5, which is a horizontal partial cross-section, this plate joint 21 and the sealing joint 26, placed between and at the end of the two conical surfaces 17 of the female 10A and male 10B flanges, also appear.

Figure 6A:
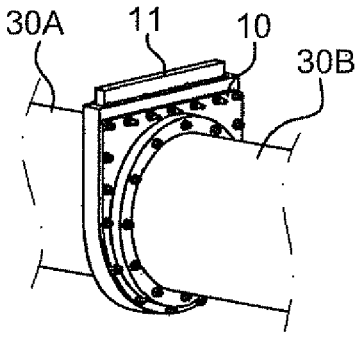

In reference to FIG. 6A, in the passive state of the system according to the invention, on an installation, the confinement flange 10 is tightly fixed between two equipment items 30A and 30B connected through this flange 10.

The first step consists of removing the cover 11 held by fixing screws on the female flange. Given that there is a vacuum inside the installation, this is kept in place. It may potentially be secured there by wing screws.

Figure 6B:
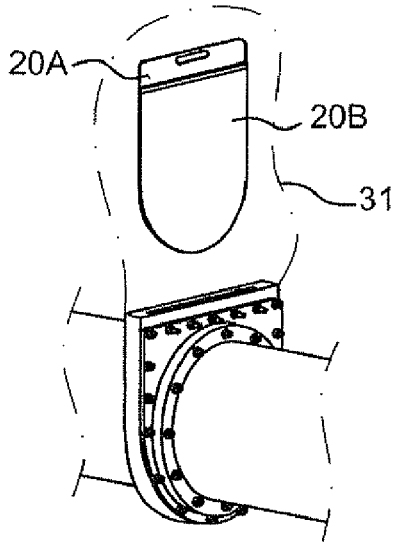

The second operation consists of bringing the assembly of the two closure plates 20*a* and 20B forming a guillotine, through a vinyl sack 31 fixed on the double groove referenced as 15 in FIG. 2, as shown in FIG. 6B.

Figure 6C:
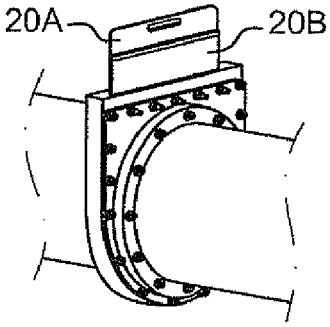

The third phase is illustrated by FIG. 6C and consists of inserting the two closure plates 20A and 20B into the slot 12 of the confinement flange 10. This operation is done through the sack 31 by laterally pushing the cover, the handle referenced as 22 in FIG. 3A making it possible to correctly position this assembly at the bottom of the housing formed by the confinement flange 10.

Figure 6D:
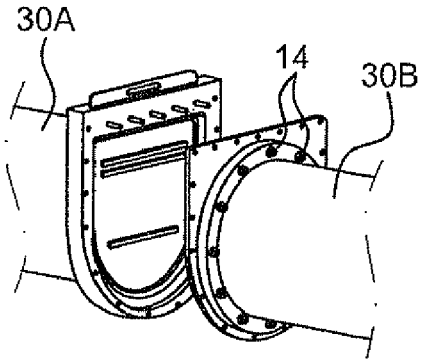

In reference to FIG. 6D, the fixing screws 14 are then removed and the two equipment items 30A and 30B are separated.

ADVANTAGES OF THE INVENTION

The interest of the proposed solution is to make it possible to insert, simply, from the outside, closure plates forming guillotines, to limit the dissemination of pollution, during disassembly. The steps which must follow an operation of this type are local decontamination of the zone defined in particular by FIGS. 3A and 3B between the two closure plates 20A and 20B, and the placement of a cover for permanent tightness.

This assembly constitutes a passive mechanism, requiring no maintenance, other than monitoring of the sealing joint 26 serving to maintain the vacuum.

The bulk of the assembly is limited.

In the framework of the use of nuclear ventilation, the dimensions of the vinyl bag to be implemented are relatively reduced and the manipulation of this bag is easy and accessible.

The confinement flange therefore makes it possible to ensure that in case of an interruption in the confinement, the passage cross-section is reduced to the passage cross-section of the closure plates, meaning that of the slot 12 of the confinement flange 10. This makes it possible to better manage the gauging of the ventilation of the nuclear installation, gauged, among other things, according to the necessary safety flows and proportionate to the passage cross-section in accident mode.

The principle of this type of guillotine is already used in industrial environments for which the cleanliness class is monitored. One may think in particular of installations relative to the optics industry. In these applications, the plates used as guillotines are then inserted at the level of the junction plane between the two concerned interfaces. On the contrary, in the present case, the insertion plane of the two closure plates is different from the joint plane defined by the position of the sealing joint 26 between the two male 10B and female 10A confined flanges.

The confinement flanges are useful in the case of a vacuum process where one wishes to maintain confinement, during disassembly of part of the equipment, after returning to atmospheric pressure, one may think in particular of radiological confinement, of cleanliness and chemical.

This system is intended to be applied first to an installation implementing a high-intensity laser, in which the experiment chamber is placed under vacuum, during a firing and to a radiological confinement function. The confinement flanges may then be used for disassembly of insertion systems, during the establishment of diagnostics in a transitory phase or during a period of increased radiological risk where one wishes to disassemble the equipment under confinement, without using costly systems, such as those described in the paragraphs on the prior art.

In the nuclear field, this system makes it possible to disassemble equipment having occasional maintenance and which does not justify the presence of a gate or a tight double door transfer system and for which maintenance in confinement is difficult.

Lastly, the flanges may be used for the disassembly of portholes under vacuum, for which one may wish to control dust accumulation during intervention. In this case, it is the outside environment which is considered to be the polluting environment.

The invention claimed is:

1. System for separating two equipment items (30A, 30B) each having a chamber operatively linked to the chamber of the other equipment item under vacuum for limiting the dispersion of pollution external of each chamber of the equipment items, during maintenance operations, comprising:

a confinement flange (10) placed between and fixed to the two chambers of the equipment items (30A, 30B) including a female flange (10A) and-a male flange (10B), with the male and female flange being affixed to one another in stationary alignment on opposite sides of a slot (12) having open ends, said slot extending through said confinement flange and a removable cover for blocking one end of this slot, two closure plates (20A, 20B) able to be placed against each other to be inserted from the outside of the confinement flange into the slot (12), upon removal of said cover, to tightly cover the chambers opposite the confinement flange (10).

2. Separation system according to claim 1, wherein said removable cover extends longitudinally over said one end of said slot (12).

3. Separation system according to claim 2, further comprising a cover joint (27) placed between the cover and the confinement flange (10).

4. Separation system according to claim 1, further comprising a sealing joint (26) placed between the female flange (10A) and the male flange (10B), in a different plane from that defined by the slot (12) and the plane of the closure plates (20A, 20B).

5. Separation system according to claim 1, further comprising a handle (22) placed on one of the two closure plates with the female closure plate (20A) being larger than the male closure plate (20B).

6. Separation system according to claim 5, further comprising a double groove (15) on the exterior part of the female flange (20A) intended for fixing a sealing bag (31).

7. Separation system according to claim 1, further comprising a plate joint (21) placed between the closure plates (20A, 20B).

8. Closure system according to claim 1, further comprising a pollution joint (28) around the slot (12) to insulate the opening formed by the slot.

9. Separation system according to claim 6 wherein said seal bag is a vinyl bag.

* * * * *